US005156021A

United States Patent [19]

St-Gelais et al.

[11] Patent Number: 5,156,021

[45] Date of Patent: Oct. 20, 1992

[54] REFRIGERATOR SHELF-LIKE WATER TANK

[76] Inventors: Gino St-Gelais, 1195 Iberville Street, apt. 4, Repentigny, Québec, Canada, J5Y 3H7; Serge Pilon, 281, Bonnard Street, Le Gardeur, Québec, Canada, J5Z 4H7

[21] Appl. No.: 740,110

[22] Filed: Aug. 5, 1991

[51] Int. Cl.[5] ..... F25D 23/12; F25D 25/02

[52] U.S. Cl. ..... 62/382; 62/338; 312/408

[58] Field of Search ..... 62/258, 259.1, 336, 62/337, 338, 382, 389, 458; 312/404, 405.1, 408, 236; 220/480, 481, DIG. 18

[56] References Cited

U.S. PATENT DOCUMENTS

| | | | |
|---|---|---|---|
| 1,887,125 | 11/1932 | Green . | |
| 2,020,963 | 11/1935 | Reid | 62/338 X |
| 2,027,092 | 1/1936 | Dowell | 62/338 X |
| 2,477,210 | 7/1949 | Skinner . | |
| 2,781,153 | 2/1957 | Roberts | 62/338 X |
| 2,788,642 | 4/1957 | Burkhead et al. . | |
| 2,871,675 | 2/1959 | Cornelius | 62/258 |
| 2,982,114 | 5/1961 | Cobb et al. | 62/338 |
| 3,024,621 | 3/1962 | Parker . | |
| 3,111,014 | 11/1963 | Herrick | 62/338 X |
| 3,357,201 | 12/1967 | Toyama | 62/382 |
| 3,570,266 | 3/1971 | Alvarez et al. | 62/338 |
| 3,707,317 | 12/1972 | Dawley et al. | 312/408 |
| 3,914,957 | 10/1975 | Jacobs | 62/338 |
| 3,984,163 | 10/1976 | Boorman, Jr. et al. | 312/408 |
| 4,288,995 | 9/1981 | Grimm et al. | 62/382 |
| 4,488,412 | 12/1984 | Weaver et al. | 62/382 |
| 4,539,819 | 9/1985 | Alba et al. | 62/382 X |
| 4,736,997 | 4/1988 | Besore et al. | 312/408 |
| 4,923,260 | 5/1990 | Poulsen | 312/408 |
| 5,004,302 | 4/1991 | Stocking et al. | 312/408 |

FOREIGN PATENT DOCUMENTS

| | | | |
|---|---|---|---|
| 2543127 | 9/1984 | France | 62/338 |

*Primary Examiner*—Henry A. Bennett
*Assistant Examiner*—Christopher B. Kilner
*Attorney, Agent, or Firm*—Pierre Lesperance; Francois Martineau

[57] ABSTRACT

A refrigerator in which one of the horizontal grill-work shelves is replaced by a shallow, flat, water tank. The tank is supported by the same support brackets as the grill-work shelf it replaces. The tank bottom wall includes fore and aft extending grooves, for engagement by the support brackets. The upturned ledge at the free end of each support bracket engages a deeper groove portion at a front section of the main grooves, this groove portion extending short of the front edge of the tank. Thus, only partial forward withdrawal of the tank from the refrigerator chamber will be possible in the horizontal plane, accordingly with the play of the ledge along the deeper groove portion. This will prevent its accidental fall-out.

5 Claims, 3 Drawing Sheets

REFRIGERATOR SHELF-LIKE WATER TANK

FIELD OF THE INVENTION

This invention relates to accessories for refrigerators, particularly fluid tanks to be cooled within the refrigerator cooling chamber.

BACKGROUND OF THE INVENTION

To cool water in a water tank, one preferred method is to put the loaded tank into the cold chamber of a refrigerator for a few hours. This of course requires a good deal of available space in the refrigerator chamber, the more so if the tank volume is large. Additionally, the conventional grill-work shelves laid therein in horizontal arrangements, are interspaced in successive pairs by relatively small vertical clearances which may not enable free engagement of the water tank unless one shelf is removed—a nuisance.

Those skilled in the art have thus in the past tried to improve the efficiency in space allocation within a refrigerator. Indeed, a refrigerator is usually one of the most expensive—if not the most expensive—of all the household appliances. The retail price of—say—a 18 cubic feet volume refrigerator can be as high as twice the retail price of a 15 cubic feet volume refrigerator. Therefore, the smallest refrigerator for the household needs is certainly desirable from a financial standpoint.

The U.S. Pat. No. 2,788,642 issued in 1957 to Bessie and Joseph BURKHEAD, does disclose a combined refrigerator shelf and liquid tank 28 to be removably edgewisely supported by one of the same side support brackets 26 as are used to support the regular grill-work shelves. The tank includes a flat rectangular shelf top wall, for receiving thereon foodstuff. The tank includes a water inlet means 38, 44 and a water outlet 46 extending through a side wall of the refrigerator and provided with a stopcock valve 48 on the outside.

One drawback of the Burkhead water tank is that its water outlet faucet 46 is embedded into one side wall of the refrigerator. This substantially complicates matters when removal of the tank from the refrigerator is required, for example for maintenance purposes.

OBJECT OF THE INVENTION

The gist of the invention is to address the problem outlined in the above background of the invention paragraph.

SUMMARY OF THE INVENTION

In accordance with the object of the invention, there is disclosed a refrigerator defining a front access door leading to an inner cooling chamber and a back wall opposite said access door, said inner chamber adapted to be divided in subcompartments by a number of vertically spaced, horizontally extending foodstuff shelves each supported by support bracket means, a liquid tank of a size to fit within said inner chamber being mounted therein between two successive horizontal grill-work shelves; said tank being supported by one of said support bracket means, the latter consisting of a few elongated, fore and aft extending, each bracket plate anchored at its rear end to said back wall by anchor means and having a front end extending short of said access door and defining an upturned ledge; said tank having a flat top wall for use as a foodstuff shelf, a bottom wall for supporting engagement with said support bracket plates, and an edgewise wall merging said top and bottom walls, a fluid inlet provided on its top wall, a fluid outlet provided on a front portion of said edgewise wall, a few fore and aft extending elongated, substantially straight grooves edgewisely slidingly releasably engaged by corresponding said support bracket plates for guided fore and aft displacement of the tank in a substantially horizontal plane, each said elongated groove defining an inwardly offset front portion being deeper than the remainder thereof and slidingly releasably engaged by said front upturned ledge of the corresponding support bracket plate whereby a partially forwardly retracted limit position of said tank is defined upon said horizontal displacement of the tank bringing said ledge against the rear edge of said groove deeper front portion, said fluid outlet clearing said cooling chamber in said partially retracted limit position of the tank.

DETAILED DESCRIPTION OF THE INVENTION

Figure 1:
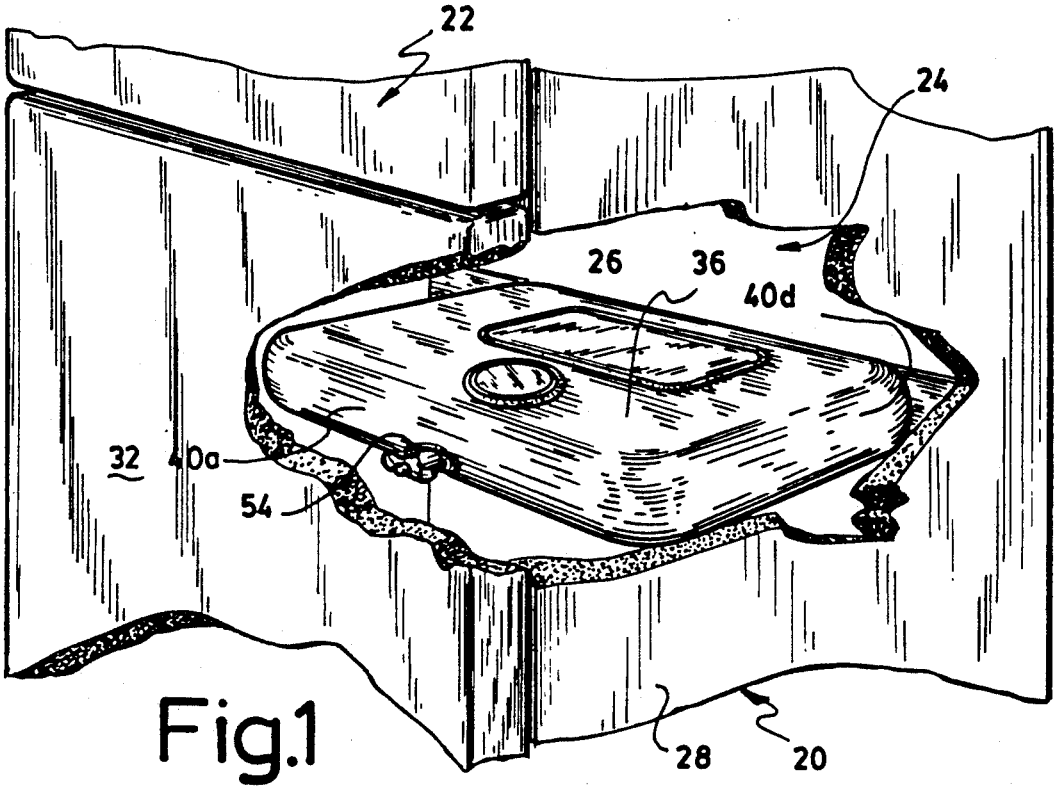
FIG. 1 is an isometric broken view of an intermediate portion of upstanding refrigerator, with a cut-away thereof revealing therein the combined water tank and horizontal shelf of the invention.

Refrigerator 20 consists of a housing 22 enclosing a thermally insulated inner chamber 24. Housing 22 conventionally includes a back wall 26, side walls 28, 28, top and bottom walls (not shown), and a front opening 30 closed by an edgewisely hinged door 32. Freon means lowers and maintains the temperature within chamber 24 to about 4° C. Grill-work shelves (not illustrated) are positioned horizontally in vertically spaced fashion on side support brackets 36, within the refrigerator chamber 24, in the usual manner.

Figure 5:
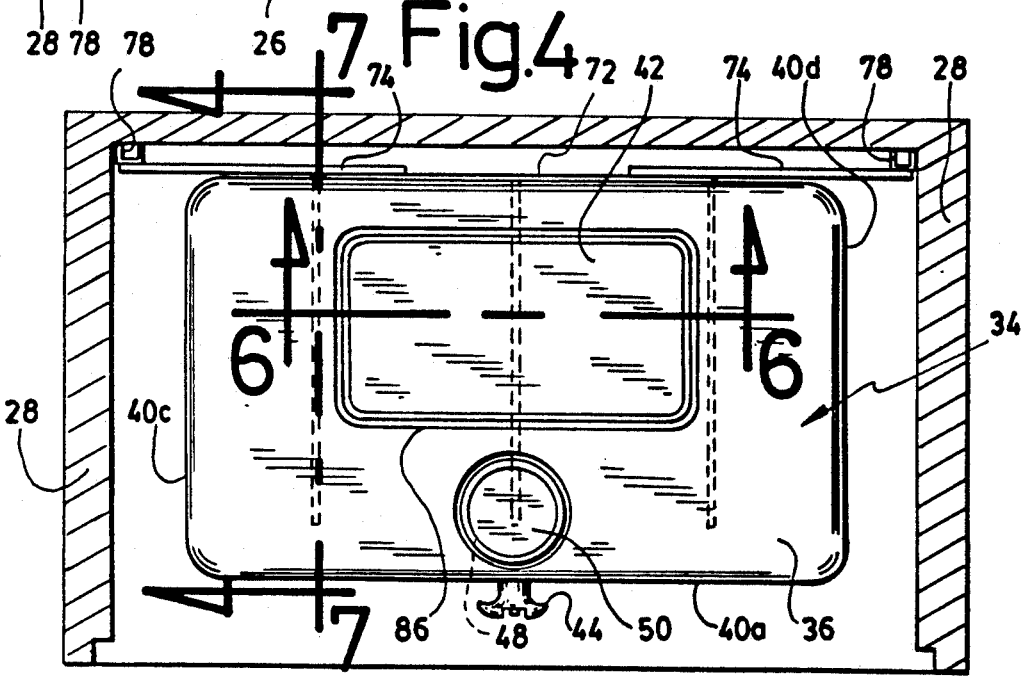
FIG. 5 is a sectional plan view of the elements of FIG. 4, taken along line 5—5 of FIG. 4.
Figure 6:
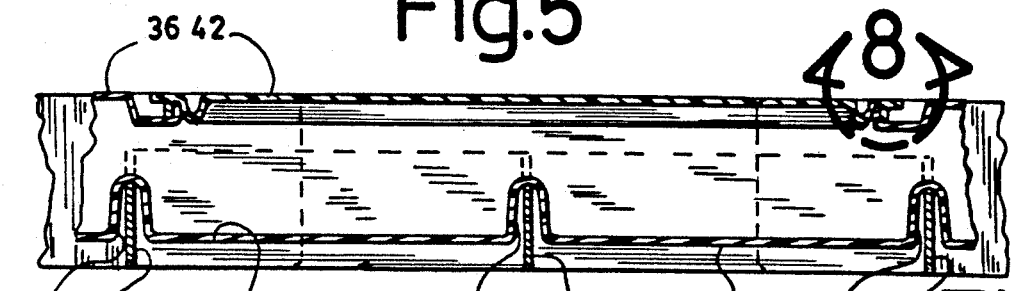
FIG. 6 is an enlarged cross-section taken along line 6—6 of FIG. 5.
Figure 8:
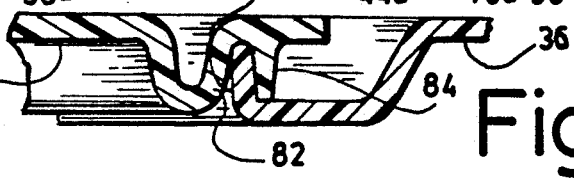
FIG. 8, on the second sheet of drawings, is an enlargement of area 8 of FIG. 6.

Accordingly with the invention, one of the grill-work shelves is removed from the refrigerator and replaced by a water tank 34. Tank 34 is generally rectangular but relatively thicker, to generally conform to the shape of the grill-work that it replaces, and is removably supported by the same side support brackets 36 as are used for support of the regular grill-work shelves. Preferably, tank 34 is of integral construction, consisting of two quadrangular, main, opposite, top and bottom walls 36, 38, edgewisely joined parallel to one another by convex, peripheral side walls 40*a*–40*d* at the four sides thereof. Advantageously, the tank top wall 36 includes a large, central, see-through plastic window 42, and bottom wall 38 includes at least three fore and aft extending invaginations or grooves 44*a*, 44*b*, 44*c*. Grooves 44*a*–44*c* extend short of front convex edge portion 40*a*, but does extend through rear convex edge portion 40*b* as suggested by the phantom lines in FIG. 5. Tank 34 sealingly encloses an inner chamber 46. Water may be poured into tank 34 through an inlet 48 on top wall 36, a plug 50 releasably closing inlet 48 in any suitable fashion.

A water outlet 52 is provided intermediately of front wall 40*a*. A handle 54 is anchored into outlet 52 and defines a first channel portion 56, extending through wall 40*a* into chamber 46, and a second channel member 58, forming a continuous elbowed channel with portion 56 and extending outwardly from chamber 46 vertically downwardly beyond the plane of bottom wall 38. Channel 56, 58 enables escape of water from chamber 46, through wall 40*a* downwardly forwardly of the fluid container 34. Channel 56 includes a water intake 56*a*, at its inner end and a diametrally smaller outer section 56*b*, wherein an intermediate annular conical seat 56*c* is defined. Intake 56*a* defines a radially inward annular groove 56*d* engaged by an annular ring 60. A conical valve 62 is biased against conical seat 56*c* by a coil spring 64, extending within channel 56 and endwisely abutting against ring 60 at its inner end. Thus, spring biased valve 62 seals channel 56, preventing fluid passage therethrough. A piston rod 66 is endwisely connected to the outer apex of conical valve 62, and extends through channel 56*b* and through a diametrally still smaller coaxial channel extension 56*e* which opens outwardly of handle 54. A stud 68 projects from the outer end of rod 66 partly beyond channel 56*e*. Stud 68 conforms diametrally to channel 56*e*, to prevent passage of water through the latter—although water will not normally engage channel extension 56*e* which is downstream of vertical water outlet channel 58 through which water will fall under gravity. Pushing stud 68 inwardly releases valve 62 from seat 56*c*, against the bias of spring 64 thus reestablishing fluid communication between elbowed channels 56*b* and 58.

Figure 4:
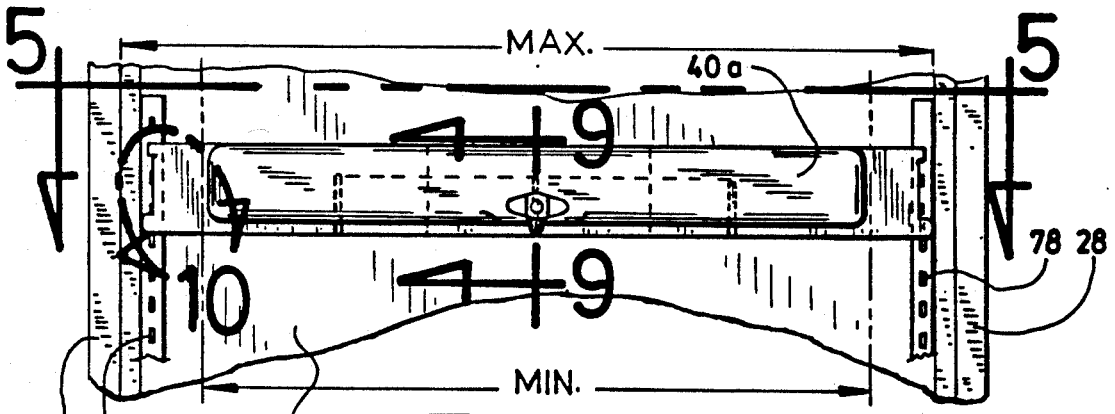
FIG. 4 is a front elevational view of the water tank, fitted to the back wall of the refrigerator according to the invention.

Each groove 44*a*–44*c* of the water tank 34 is to be lengthwisely engaged by conventional refrigerator support brackets 70*a*–70*c* respectively, of the type used for supporting conventional grill-work shelves. Brackets 70*a*–70*c* are endwisely connected to an integral transverse web plate 72. Hook plates 74, 74 are to be anchored to web plate 72 by screws (not shown), extending through bores in the former and lengthwise slits 76 on the latter. Hooks 74 are then clamped releasably to the standard vertical railing 78 (FIG. 4) anchored to the refrigerator back wall 26 adjacent side walls 28, 28 at a selected height in the well known fashion. Thus, slits 76 on web 72 enable adjustment of the tank support brackets 70*a*–70*c* to refrigerators of various widths.

Figure 7:
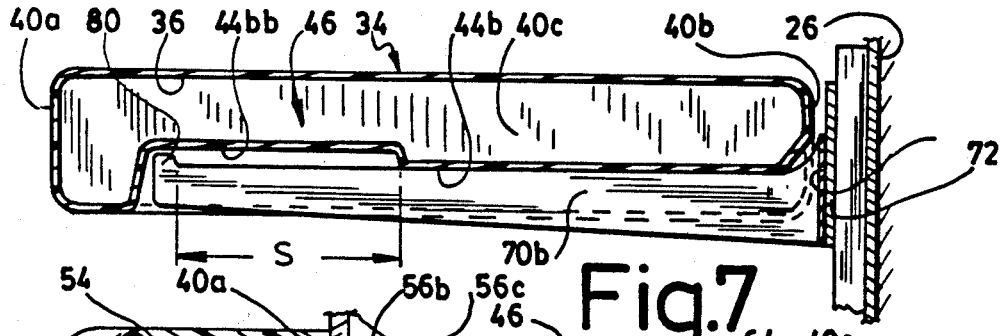
FIG. 7, on the third sheet of drawings, is an enlarged cross-section taken along line 7—7 of FIG. 5.
Figure 9:
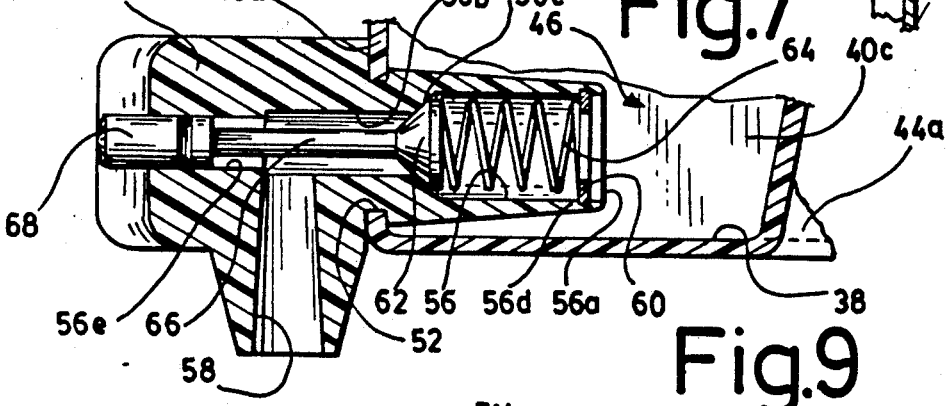
FIG. 9 is an enlarged cross-sectional view taken along line 9—9 of FIG. 4.
Figure 11:
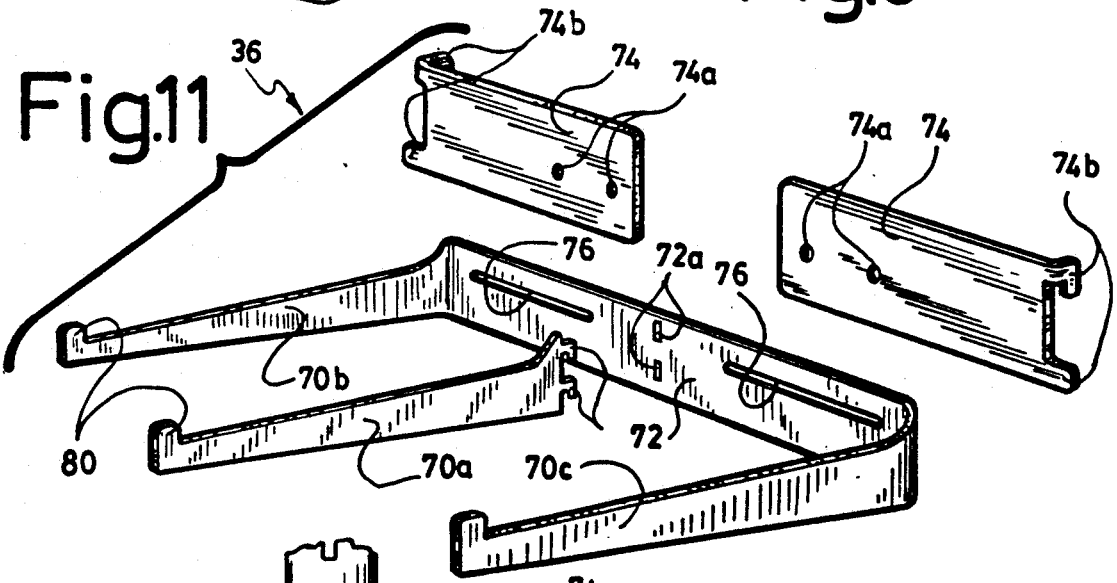
FIG. 11 is an exploded view of the stay assembly for supporting the water tank of the invention.
Figure 10:
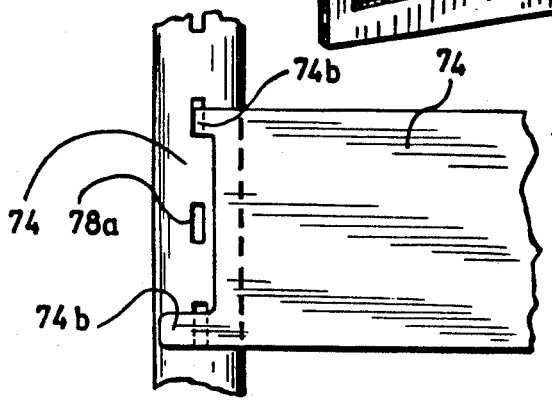
FIG. 10 is an enlarged view of the area within area 10 of FIG. 4.

Preferably, the front leg of each groove 44*a*–44*c*—extending short of the front wall 40*a*—is itself grooved, see reference 44*bb* at FIG. 7. Since each bracket leg 70*a*–70*c* has a conventional upturned ledge 80 at its free end, the latter will freely engage into deeper grooves 44*aa*, 44*bb* and 44*cc* while the main part thereof abuttingly supports flooring 38 within grooves 44*a*, 44*b*, 44*c*. Hence, as suggested in FIG. 2, tank 34—when applied against back wall 26 and supported by brackets 70*a*–70*c*-will be horizontally forwardly slidable over brackets 70*a*–70*c*, away from back wall 26, for a fraction of the total length of the water tank i.e. a distance equal to groove portions 44*aa*, 44*bb*, 44*cc*, until the ledges 80 come to sit against the rear edge of the latter groove portions. At this partially retracted position of the water tank, the front stopcock 54 will clear the underlying grill-work shelves thus enabling its opening for pouring water from tank 34 into a hand supported glass. It is understood that in such a condition, there is no need to hold in position the tank 34, wherein due to its horizontal plane, it will allow easy outflow of water without having to lift the rear portion thereof. Thereafter, to release tank 34 from brackets 70, one will have to simply lift same therefrom, thus preventing accidental fall-out thereof if the pulling force is too strong.

Figure 2:
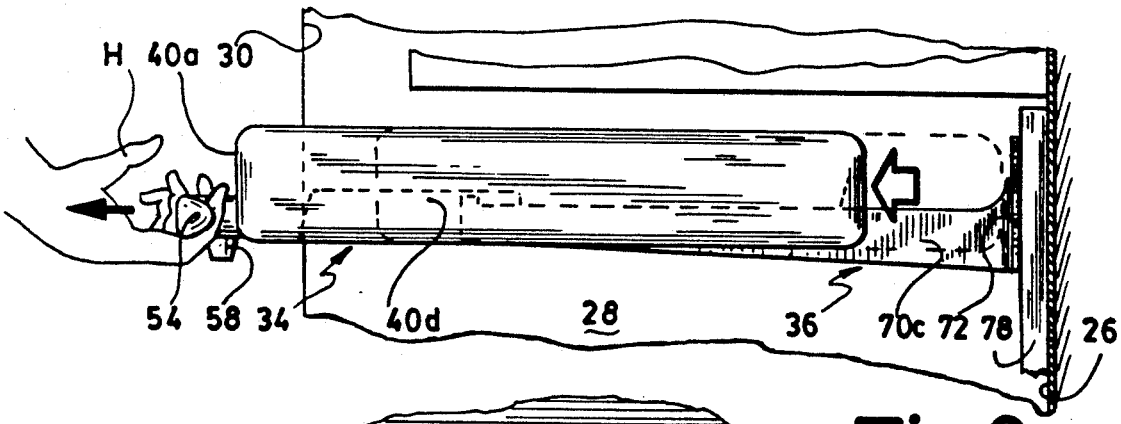
FIG. 2 is a sectional side elevation of the refrigerator portion of FIG. 1, suggesting how the present invention water tank may be manually disengaged from with its fully engaged position inside the refrigerator main chamber.
Figure 3:
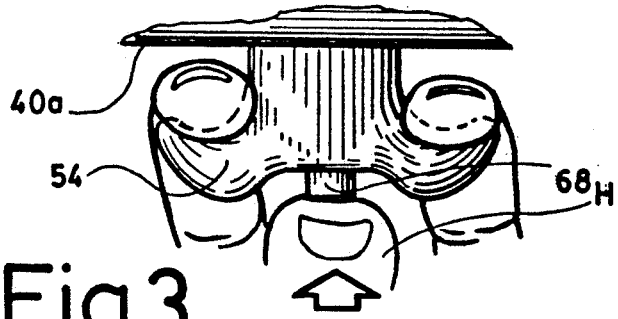
FIG. 3 is an enlarged plan view of the maneuvering handle of the tank.

Handle 44 is used with one's hand H:

(a) as a pulling means, to slidingly pull tank 34 horizontally away from back wall 26, see FIG. 2;

(b) as an abutment means, for the manual holding in place of tank 34 (to prevent rearward displacement thereof) during compression of stopcock valve release button 68, for escape of water through water outlet 58, see FIG. 3;

(c) as a means for pivotally lifting the water container 34 from its horizontal position, upwardly rearwardly to a vertical position; and as a means for hand-carrying tank 34 in vertical suspended condition over ground.

Window 42 may simply be a transparent plastic plate having an edgewise groove member 82, being engaged by an upturned ledge 84 defining the contour of the aperture 86 in wall 36 closed by window 42.

I claim:

1. In a refrigerator defining a front access door leading to an inner cooling chamber and a back wall opposite said access door, said inner chamber adapted to be divided in sub-compartments by a number of vertically spaced, horizontally extending foodstuff shelves each supported by support bracket means, a liquid tank of a size to fit within said inner chamber being mounted therein between two successive horizontal grill-work shelves; said tank being supported by said support bracket means, the latter consisting of a plurality of elongated, fore and aft extending bracket plates, each bracket plate anchored at its rear end to said back wall by anchor means and having a front end extending short of said access door and defining an upturned ledge; said tank having a flat top wall for use as a foodstuff shelf, a bottom wall for supporting engagement with said support bracket plates, and an edgewise wall joining said top and bottom walls, a fluid inlet provided on its top wall, a fluid outlet provided on a front portion of said edgewise wall, a plurality of fore and aft extending elongated, substantially straight grooves formed in the bottom wall of said being slidingly and releasably engaged by said support bracket plates for guided fore and aft displacement of the tank in a substantially horizontal plane, each said elongated groove defining an inwardly offset front portion being deeper than the remainder thereof and slidingly and releasably engaged by said front upturned ledge of the support bracket plate whereby a partially forwardly retracted limit position of said tank is defined upon said horizontal displacement of the tank bringing said ledge against the rear edge of said groove deeper front portion, said fluid outlet clearing said cooling chamber in said partially retracted limit position of the tank.

2. A water tank as defined in claim 1, wherein said tank bottom wall grooves front portions extend short of said tank edgewise wall front portion.

3. A water tank as defined in claim 1, wherein said fluid outlet is provided with manually-controlled, spring-biased, stop cock means.

4. A water tank as defined in claim 1, wherein said bracket plate anchor means consists of a web member, integrally and orthogonally interconnecting the bracket plates in laterally spaced apart fashion, a pair of elongated rail bars anchored to said refrigerator back in laterally spaced, vertically extending condition, each rail bar having a plurality of slits, and a pair of hook members releasably anchoring said web member to said rail bars about selected slits thereof.

5. A water tank as defined in claim 4, further including adjustment means, for laterally adjusting the relative positions of said hook members about said web member to be able to fit said water tank in refrigerators of various lateral dimensions.

* * * * *